US012098003B1

(12) United States Patent
Wang

(10) Patent No.: US 12,098,003 B1
(45) Date of Patent: Sep. 24, 2024

(54) ONE-PIECE CARTON WITH CHILD-RESISTANT FUNCTION

(71) Applicant: KDELTA technology, Shenzhen (CN)

(72) Inventor: Shuanglang Wang, Shenzhen (CN)

(73) Assignee: KDELTA TECHNOLOGY, Shenzhen (CN)

( * ) Notice: Subject to any disclaimer, the term of this patent is extended or adjusted under 35 U.S.C. 154(b) by 0 days.

(21) Appl. No.: 18/448,937

(22) Filed: Aug. 13, 2023

(30) Foreign Application Priority Data

Jul. 27, 2023 (CN) ..... 2023219954872

(51) Int. Cl.
*B65D 50/04* (2006.01)
*B65D 5/66* (2006.01)

(52) U.S. Cl.
CPC ..... *B65D 50/046* (2013.01); *B65D 5/66* (2013.01); *B65D 2215/02* (2013.01)

(58) Field of Classification Search
CPC .... B65D 50/046; B65D 5/66; B65D 2215/02; B65D 5/38
USPC ..... 229/102, 125.26, 125.27; 206/1.5, 538
See application file for complete search history.

(56) References Cited

U.S. PATENT DOCUMENTS 1,414,236 A * 4/1922 William ..... B65D 5/0245 229/104
6,491,211 B1 * 12/2002 Evans ..... B65D 77/02 206/532

FOREIGN PATENT DOCUMENTS

| | | | | |
|---|---|---|---|---|
| CA | 3051685 A1 * | 1/2021 | ..... | B65D 5/38 |
| CN | 211691934 U | 10/2020 | | |
| CN | 212149632 U | 12/2020 | | |
| CN | 112830045 A | 5/2021 | | |
| WO | WO-2020033044 A1 * | 2/2020 | ..... | B65D 5/38 |
| WO | WO-2021032621 A1 * | 2/2021 | ..... | B65D 5/38 |

* cited by examiner

*Primary Examiner* — James N Smalley
(74) *Attorney, Agent, or Firm* — Zhigang Ma

(57) ABSTRACT

Provided is a one-piece carton having a child-resistant function comprising a box body, which is a cuboid and comprises an accommodation cavity inside; wherein one side of the accommodation cavity is provided with an opening; the box body is provided with a locking piece and a closure panel; the locking piece comprises a pair of clamping pieces that expand outward and are foldably attached to the locking piece; the opening of the accommodation cavity is provided with a pair of engaged parts; and the box body is provided with pressing pieces corresponding to the clamping pieces.

7 Claims, 7 Drawing Sheets

ONE-PIECE CARTON WITH CHILD-RESISTANT FUNCTION

CROSS-REFERENCE TO RELATED APPLICATIONS

The application claims priority to Chinese patent application No. 2023219954872, filed on Jul. 27, 2023, the entire contents of which are incorporated herein by reference.

TECHNICAL FIELD

The present invention relates to the field of packaging cartons, in particular to a one-piece carton having a child-resistant function.

BACKGROUND

Conventional sharps packaging, cosmetics packaging, etc., mostly employ plastic and paper cartons. Packaging boxes adopt the form of an inner box and an outer box, and the inner box is slidably nested in the outer box. Products in packaging boxes of such structural design are easily obtained as users may accidentally pull out an inner box during use; in addition, for families with children, children may pull out an inner box without difficulty. Hence, users and children may be accidentally injured or suffer from unnecessary troubles.

Later, there is a child-resistant packaging box for security packaging (such as the earlier Chinese patent application CN 112830045 A), comprising an outer box and an inner box, between which a locking structure is configured, so that users need to unlock the locking structure when pulling out the inner box, thereby improving the security. However, this packaging box for security packaging also has some shortcomings, to be specified: the packaging box for security packaging comprises an outer box and an inner box, which increases the manufacturing materials, thereby increasing manufacturing cost;

Therefore, there is a need of developing a novel technical solution to solve the aforementioned problems.

SUMMARY

In order to solve the defects and deficiencies of the above-mentioned prior art, the present invention provides a one-piece carton having a child-resistant function, which achieves the design of a locking structure by directly configuring a locking piece and pressing pieces on a box body. The present invention saves more materials and is also conducive to the automatic production of cartons compared with packaging boxes in a split design.

For the aforementioned purposes, the present invention adopts the following technical solutions:

A one-piece carton having a child-resistant function comprises a box body made of paper, which is a cuboid and comprises an accommodation cavity inside; wherein one side of said accommodation cavity is provided with an opening; said box body is provided with a locking piece and a closure panel opposite to each other at the opening;

said locking piece comprises a pair of clamping pieces that expand outward and are foldably attached to said locking piece; the opening of said accommodation cavity is provided with a pair of engaged parts that are adaptive to the pair of said clamping pieces; and said box body is provided with pressing pieces corresponding to said clamping pieces.

In one preferred solution, said locking piece comprises a first folded piece, a second folded piece, and a third folded piece attached in sequence, three of which are foldably configured; said first folded piece is foldably attached to a first long side panel at the opening of said accommodation cavity; wherein:

the pair of said clamping pieces are configured on the left and right sides of said second folded piece, respectively; and said third folded piece is extended with a lifting piece.

In one preferred solution, said box body is a cuboid, comprising a pair of long side panels and a pair of short side panels; said locking piece and said closure panel are attached to the pair of long side panels of said box body, respectively; the pair of said clamping pieces are configured to correspond to the pair of short side panels of said box body, respectively; and correspondingly the pair of said engaged parts are configured to attach to the pair of short side panels of said box body, respectively. In one preferred solution, said clamping pieces are in the shape of isosceles trapezoid.

In one preferred solution, said first folded piece, said second folded piece and said third folded piece are all in the shape of rectangle.

In one preferred solution, clamping slits are configured between said engaged parts and one of said long side panels of said box body; said closure panel is provided with a tuck flap that is adaptive to said clamping slits.

In one preferred solution, said pressing pieces are integrally molded on said box body, and a press gap is configured between each of said pressing pieces and said box body.

Compared with the prior art, the present invention has significant advantages and beneficial effects. Specifically, with reference to the aforesaid technical solutions, the present invention achieves the design of a locking structure by directly configuring a locking piece and pressing pieces on a box body, saves more materials and is also conducive to the automatic production of cartons in relative to packaging boxes in a split design;

Secondly, the specific design of a locking piece and a closure panel (and clamping slits) allows the carton of the present application to have the advantages of reliable locking and stable closure, too.

In order to illustrate the structural features and effects of the present invention more clearly, the present invention will be described in detail below in combination with the accompanying drawings and specific embodiments.

DESCRIPTION OF REFERENCE SIGNS IN DRAWINGS

10. box body; 101. accommodation cavity; 102. first long side panel; 103. second long side panel; 104. first short side panel; 105. second short side panel; 11. engaged parts; 12. pressing pieces; 121. press gaps; 13. clamping slits; 20. locking piece; 201. first folded piece; 202. second folded piece; 203. third folded piece; 2031. lifting piece; 21. clamping pieces; 30, closure panel; 301. tuck flap; 302. fourth folded piece.

DETAILED DESCRIPTION OF THE EMBODIMENTS

The technical solutions in the embodiments of the present invention are clearly and completely described below with reference to the accompanying drawings. Apparently, the described embodiments are merely preferred embodiments of the present invention.

It should be noted that when an element is referred to as being "immobilized" to another element, it may be immobilized to another element, directly or via an intermediate element(s). When an element is referred to as being "connected" to another element, it may be connected to another element, directly or via an intermediate element(s). The terms "vertical," "horizontal," "left," "right," and the like used herein are for the purpose of illustration only and do not indicate these embodiments exclusively.

Unless otherwise defined, all technical and scientific terms used herein have the same meaning as commonly understood by persons of ordinary skill in the technical field of the present invention. The terms used herein are only for the purpose of describing specific embodiments, rather than intended to limit the present invention. The term "and/or" as used herein includes any and all combinations of one or more of the related items as listed.

Figure 1:
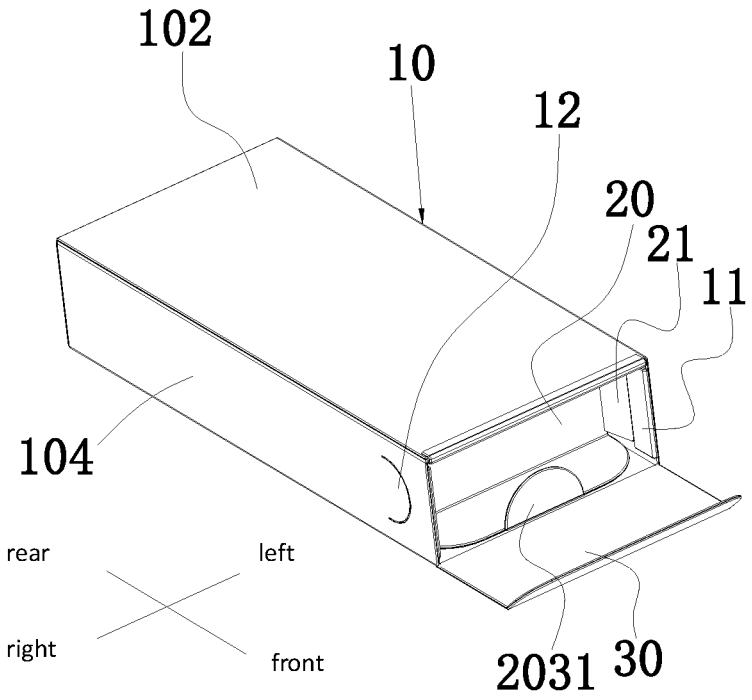
FIG. 1 is a first three-dimensional schematic view of the embodiment of the present invention (in a locked state)
Figure 2:
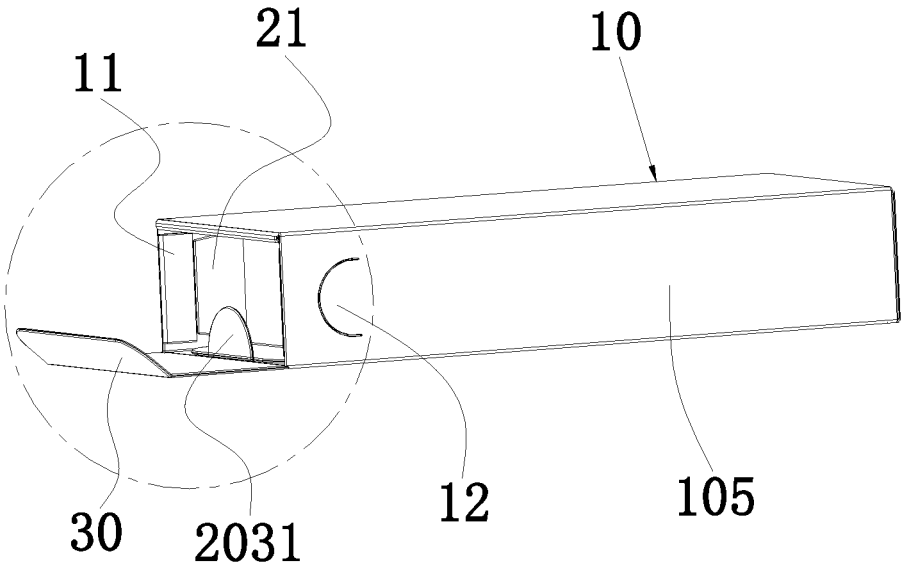
FIG. 2 is a second three-dimensional schematic view of the embodiment of the present invention (in a locked state)
Figure 3:
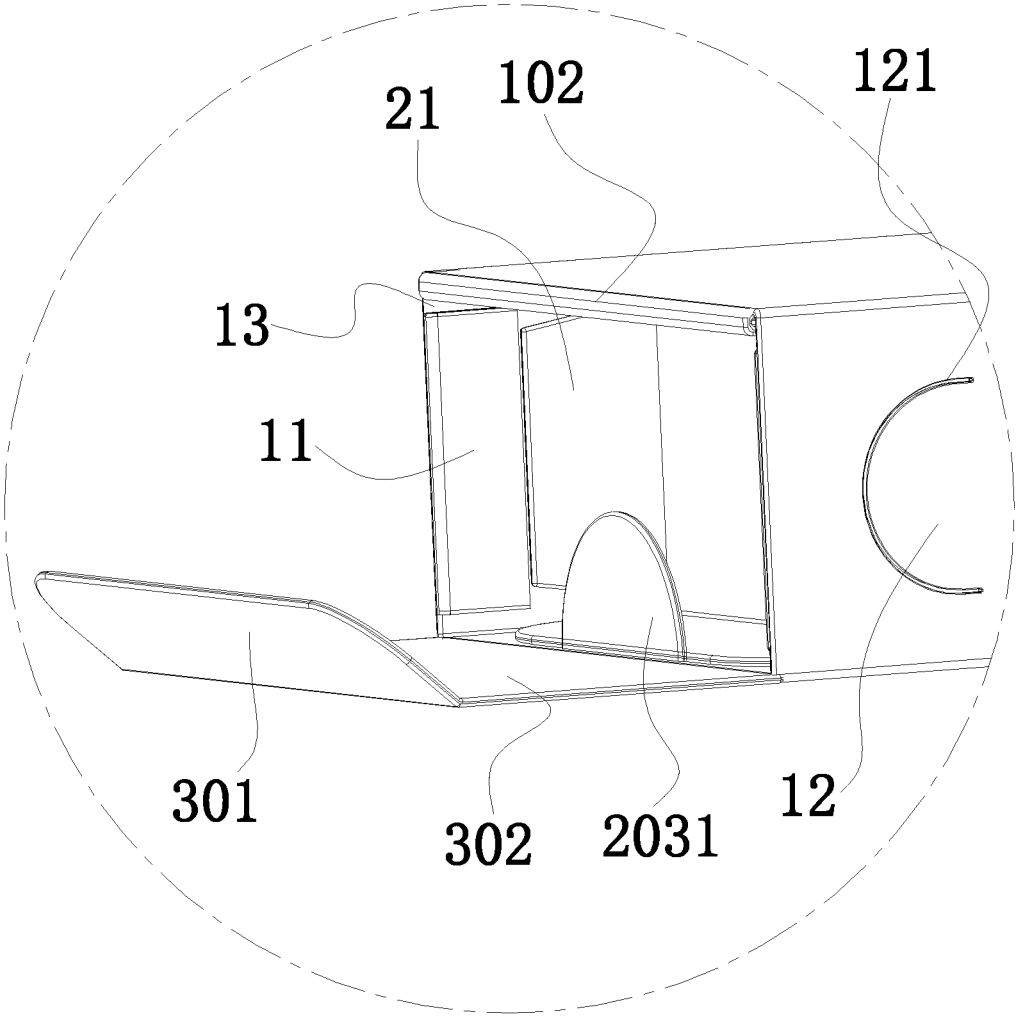
FIG. 3 is an enlarged view of a part of FIG. 2.
Figure 4:
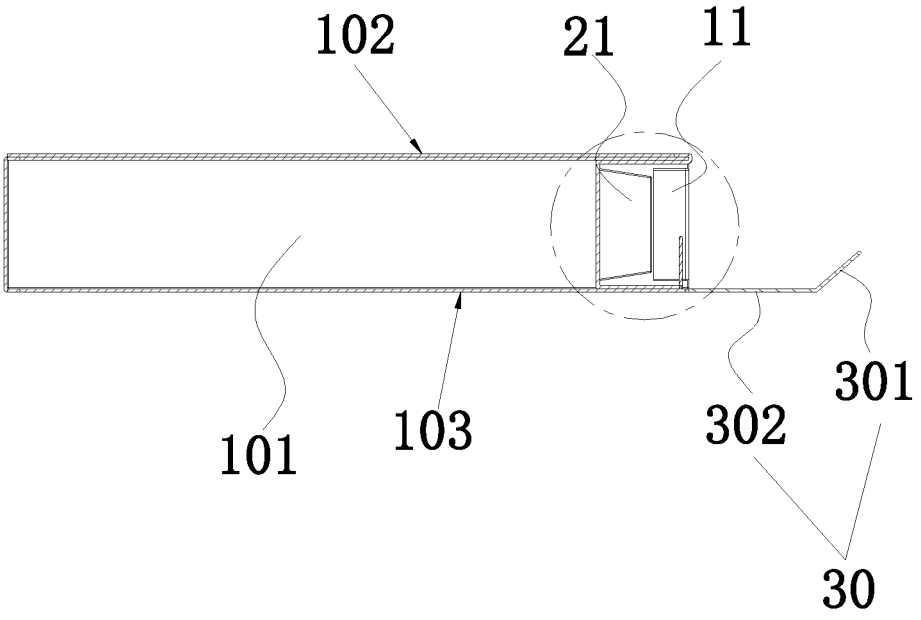
FIG. 4 is a cross-sectional view of the embodiment of the present invention.
Figure 5:
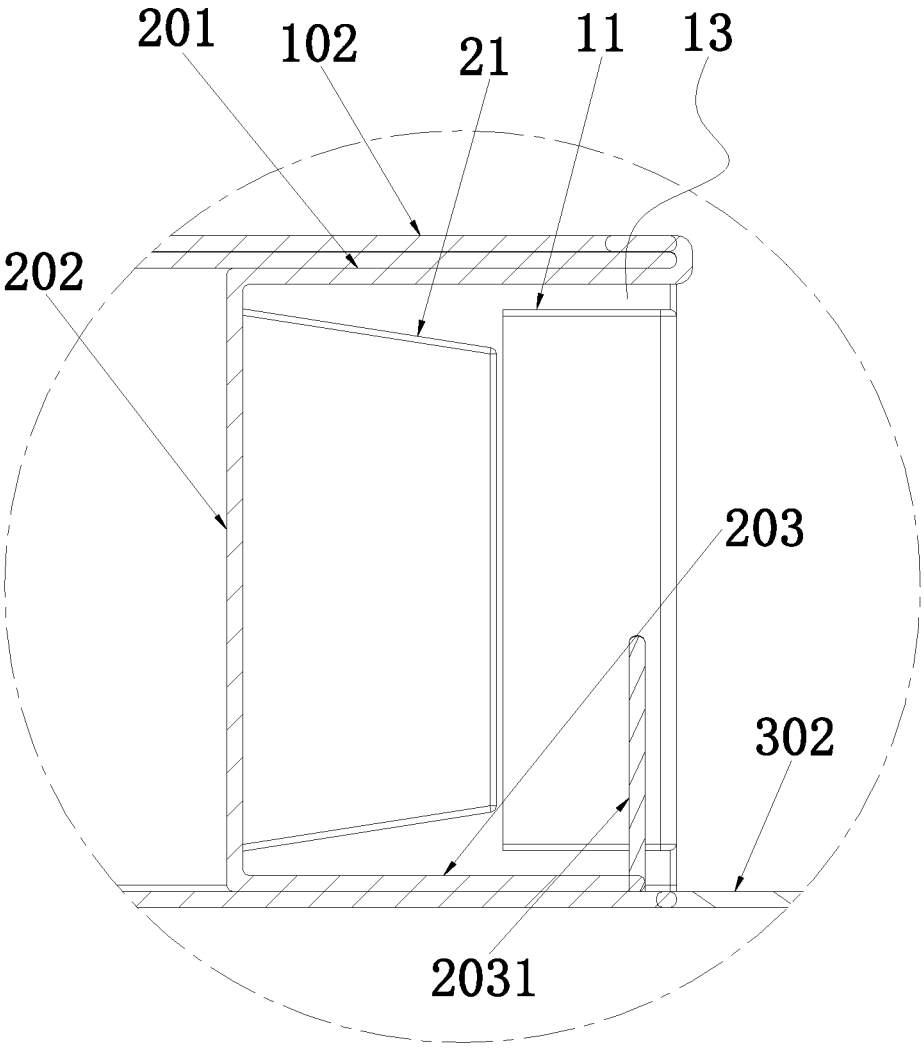
FIG. 5 is an enlarged view of a part of FIG. 4.
Figure 6:
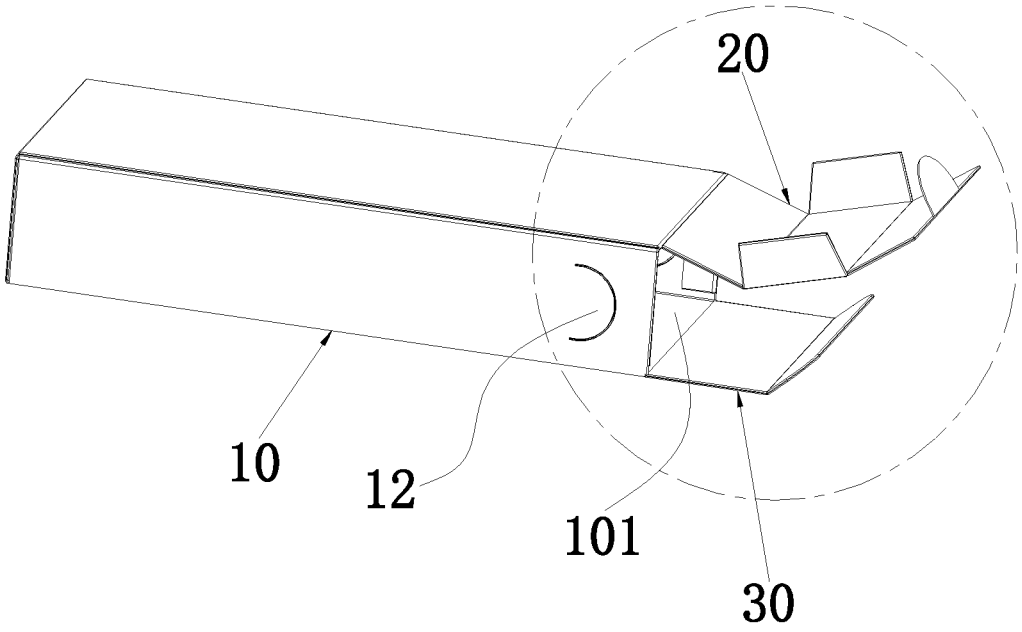
FIG. 6 is a schematic view of the embodiment of the present invention (in an unlocked state)
Figure 7:
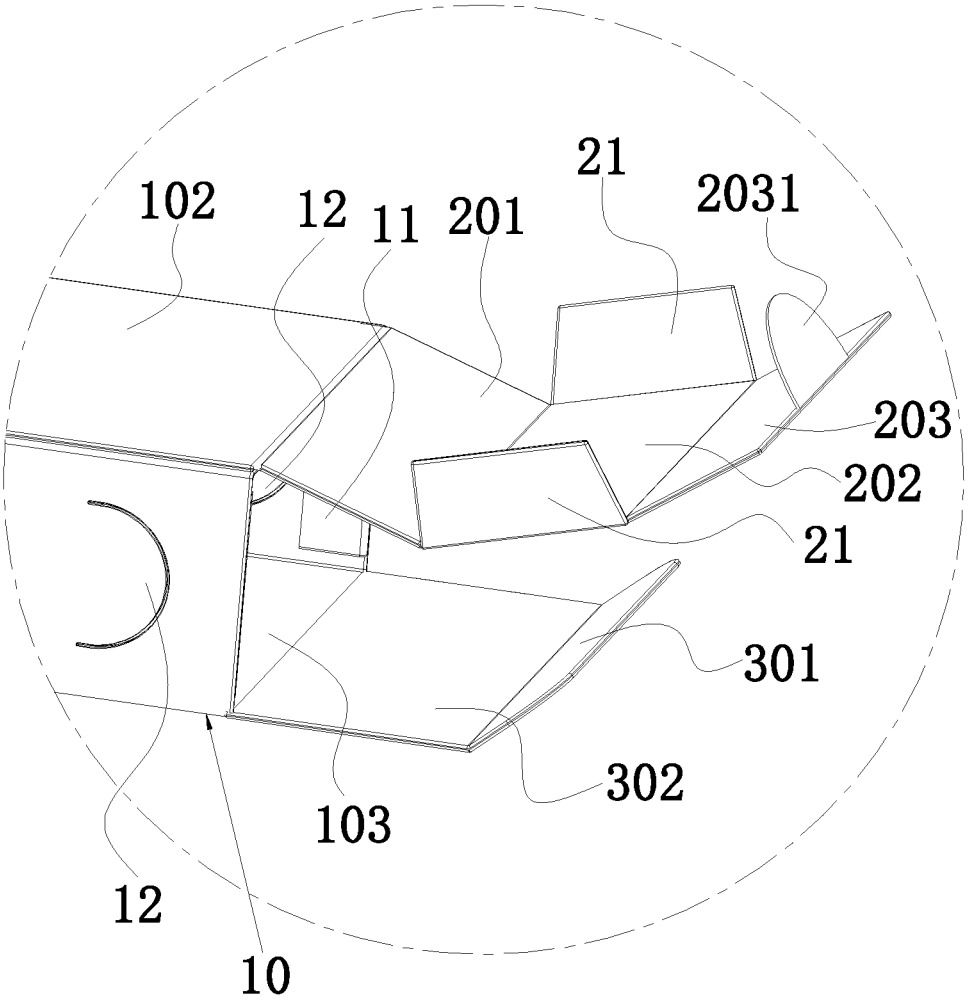
FIG. 7 is an enlarged view of a part of FIG. 6.

Referring to FIG. 1 to FIG. 7, a one-piece carton having a child-resistant function in the embodiment of the present application comprises a box body 10 made of paper which is a cuboid and comprises an accommodation cavity 101 inside; wherein one side of said accommodation cavity 101 is provided with an opening; said box body 10 is provided with a locking piece 20 and a closure panel 30 opposite to each other at the opening;

said locking piece 20 comprises a pair of clamping pieces 21 that expand outward and are foldably attached to said locking piece 20; the opening of said accommodation cavity 101 is provided with a pair of engaged parts 11 that are adaptive to a pair of said clamping pieces 21; and said box body 10 is provided with pressing pieces 12 corresponding to said clamping pieces 21.

Specifically, said box body 10 may be a cube or a cuboid, which is not specifically defined herein. When said box body 10 is a cuboid, it comprises a pair of long side panels and a pair of short side panels, which are defined as a first long side panel 102, a second long side panel 103, a first short side panel 104, and a second short side panel 105, respectively; said locking piece 20 and said closure panel 30 are configured to attach to said first long side panel 102 and said second long side panel 103 of said box body 10, respectively; a pair of clamping pieces 21 are configured to correspond to said first short side panel 104 and said second short side panel 105 of said box body 10, and correspondingly a pair of engaged parts 11 are configured to attach to said first short side panel 104 and said second short side panel 105 of said box body 10; and the first short panel 104 and the second short panel 105 of said box body 10 are configured with said pressing pieces 12.

Further, said locking piece 20 comprises a first folded piece 201, a second folded piece 202, and a third folded piece 203 attached in sequence, three of which are foldably configured; said first folded piece 201 is foldably attached to said first long side panel 102 at the opening of said accommodation cavity 101; wherein:

the pair of said clamping pieces 21 are configured on the left and right sides of said second folded piece 202, respectively; and said third folded piece 203 is extended with a lifting piece 2031. Preferably, said clamping pieces 21 are in the shape of isosceles trapezoid, each of which comprises a bottom edge and is attached to said second folded piece 202 via the bottom edge. Specifically, said first folded piece 201, said second folded piece 202, and said third folded piece 203 are all rectangular; of course, said clamping pieces 21 may be in the shape of a semicircle, a rectangle, etc., which is not specifically defined herein as long as it satisfies the locking with said engaged parts 11.

Preferably, clamping slits 13 are configured between said engaged parts 11 and said first long side panel 102 of said box body 10; said closure panel 30 is provided with a tuck flap 301 that is adaptive to said clamping slits 13. The configuration of said clamping slits 13 and said tuck flap 301 allows said closure panel 30 to securely close over the opening of said accommodation cavity 101.

Specifically, said closure panel 30 comprises a fourth folded piece 302 and said tuck flap 301, both of which are foldably attached to each other, and said closure panel 30 is foldably attached to said box body 10 via said fourth folded piece 302.

In most cases, said pressing pieces 12 are integrally molded on said box body 10, and a press gap 121 is configured between each of said pressing pieces 12 and said box body 10 so that said pressing pieces 12 are resilient.

The unlocking process of the carton of the present application is further described below:

Referring to FIG. 1 to FIG. 5, the carton is in a locked state, and when it needs to be unlocked, the pressing pieces 12 on both sides of said box body 10 are pressed so that said clamping pieces 21 of said locking piece 20 are folded inward and further disengaged from the engaged parts 11. As such, the unlocking is completed, and the locking piece 20 is opened.

The design of the present invention focuses on directly configuring a locking piece and pressing pieces on a box body, thereby achieving the design of a locking structure, and saves more materials and is also conducive to the automatic production of cartons in relative to packaging boxes in the split design;

Secondly, the specific design of a locking piece and a closure panel (and clamping slits) allows the carton of the present application to have the advantages of reliable locking and stable closure, too.

The above descriptions are merely preferred embodiments of the present invention, and shall not be construed as limitation to the technical scope of the present invention. Hence, any minor amendments, equivalent variations or modifications made to these embodiments according to the technical substance of the present invention shall still fall within the scope of technical solutions of the present invention.

What is claimed is:

1. A one-piece carton having a child lock function, comprising a box body made of paper, which is a cuboid defining an accommodation cavity inside; wherein one side of said box body is provided with an opening; said box body is provided with a locking piece and a closure panel opposite to each other at the opening;

said locking piece comprises a pair of clamping pieces that expand outward and are foldably attached to said locking piece; at the opening said box body is provided with a pair of engaged parts that are configured to resists against the pair of said clamping pieces in a locked state; and said box body is provided with pressing pieces corresponding to said clamping pieces and configured to push said clamping pieces respectively to be folded inward so as to be disengaged with the engaged parts to an unlocked state.

2. The one-piece carton having a child lock function according to claim 1, characterized in that said locking piece comprises a first folded piece, a second folded piece, and a third folded piece attached in sequence; said first folded piece is foldably attached to a first long side panel at the opening of said accommodation cavity; wherein:

the pair of said clamping pieces are configured on the left and right sides of said second folded piece, respectively; and said third folded piece is extended with a lifting piece.

3. The one-piece carton having a child lock function according to claim 2, characterized in that said box body comprises a pair of long side panels and a pair of short side panels;

wherein the pair of long side panel comprises the first long side panel and a second long side panel opposite to the first long side panel; said locking piece and said closure panel are attached to the pair of long side panels of said box body, respectively; the pair of said clamping pieces are arranged on the pair of short side panels of said box body, respectively; and correspondingly the pair of said engaged parts are configured to attach to the pair of short side panels of said box body, respectively.

4. The one-piece carton having a child lock function according to claim 3, characterized in that said clamping pieces are in the shape of an isosceles trapezoid.

5. The one-piece carton having a child lock function according to claim 3, characterized in that said first folded piece, said second folded piece and said third folded piece are all in the shape of a rectangle.

6. The one-piece carton having a child lock function according to claim 5, characterized in that clamping slits are configured between said engaged parts and one of said long side panels of said box body; said closure panel is provided with a tuck flap that is configured to be insertable into to said clamping slits.

7. The one-piece carton having a child lock function according to claim 6, characterized in that said pressing pieces are integrally molded on said box body, and a press gap is configured between each of said pressing pieces and said box body.

* * * * *